US005996137A

United States Patent [19]

Genova

[11] Patent Number: 5,996,137

[45] Date of Patent: Dec. 7, 1999

[54] SPA COVER LIFT FRAME

[75] Inventor: Michael C. Genova, Spokane, Wash.

[73] Assignee: Leisure Concepts, Inc., Spokane, Wash.

[21] Appl. No.: 09/173,132

[22] Filed: Oct. 15, 1998

[51] Int. Cl.[6] ..... E04H 4/06

[52] U.S. Cl. ..... 4/498

[58] Field of Search ..... 4/498

[56] References Cited

U.S. PATENT DOCUMENTS

| | | | |
|---|---|---|---|
| D. 384,479 | 9/1997 | Ouelette | D34/36 |
| 4,991,238 | 2/1991 | Forrest | 4/498 |
| 5,048,153 | 9/1991 | Wall et al. | 16/223 |
| 5,131,102 | 7/1992 | Salley et al. | 4/498 |
| 5,517,703 | 5/1996 | Ouelette | 4/498 |
| 5,566,403 | 10/1996 | Black et al. | 4/498 |
| 5,584,081 | 12/1996 | Ouelette | 4/498 |
| 5,634,218 | 6/1997 | Ouelette | 4/498 |
| 5,644,803 | 7/1997 | Wilson | 4/500 |
| 5,689,841 | 11/1997 | Black et al. | 4/498 |
| 5,819,332 | 10/1998 | Perry | 4/498 |

*Primary Examiner*—Charles E. Phillips

*Attorney, Agent, or Firm*—Wells, St. John, Roberts, Gregory & Matkin, P.S.

[57] ABSTRACT

A spa cover lift frame is described for a spa cover which is formed of two halves and joined along a central hinge and rests against the top of a spa having upright left and right spa side walls and an end wall leading downwardly from the spa top. The preferred lift frame includes left and right mounting brackets configured to be mounted to the respective left and right spa side walls adjacent the end wall. Each of the left and right mounting brackets are preferably comprised of an elongated bracket flange configured to be mounted flush against a side wall of the spa with the second end adjacent the spa end wall. Pivots are situated on the mounting brackets, as are pivot stops. A "U" shaped reinforced carrier, including opposed substantially parallel support arm members and a cross member extending between the support arm members, is mounted to the brackets for pivotal motion about a lift axis. The left and right mounting brackets and the carrier are configured to be mounted on the spa side walls with the carrier pivotable on the lift axis between a down position wherein the cross member is positioned against the spa cover adjacent the hinge such that the spa cover may be folded over the cross member, and a raised position wherein the folded spa cover is supported on the cross member and is substantially upright and adjacent to the spa end wall.

24 Claims, 8 Drawing Sheets

SPA COVER LIFT FRAME

TECHNICAL FIELD

The present invention relates to spa cover lifting frames.

BACKGROUND OF THE INVENTION

Covers for spas or "hot tubs" are often used in cooler climates to minimize escape of heat from the spa or generally to provide a safe covering for the spa. A typical cover is formed of two thick rigid insulation sheets that are covered with fabric. The two sheets are typically hinged between two cover halves. In most covers, the hinge is formed by a seam in the fabric covering between the two halves. It is common practice to remove such covers by swinging one cover half onto the remaining cover half, then lifting both halves from the spa. This is a difficult task since the covers are heavy and cumbersome. The task is difficult even for two people.

Various attempts have been made to alleviate the problem of lifting covers from spas by providing lift apparatus that either mounts to the spa or to surrounding deck or other support surfaces. While the prior lift devices have been operational to a degree, the task of lifting and shifting the folded covers remains a substantial chore.

Many of the devices developed are relatively complicated and expensive for the consumer to purchase and use. Numerous available lift frames also tend to "rack" or twist under the weight of the spa cover when the cover is lifted from or lowered onto the spa top. Still others must include extra bracing structure in order to hold the lifted spa cover from falling back onto the spa or occupants. And yet others gain only minimal mechanical advantage for the user, who must therefor substantially bear the weight of the spa cover while shifting it off from and onto the spa.

It is an object of the present invention to provide an improved spa cover frame that is simple in construction, inexpensive, and easy to install and operate.

A further object is to provide such a cover lift frame that does not normally require extra bracing or support to hold a folded spa cover in a stored, inoperative position alongside a spa.

A still further object is to provide such a cover lift frame that will permit lifting and lowering of a spa cover by a single person from either side or from inside the spa.

A yet further object is to provide such a cover lift frame that requires minimal space at an end of a spa for movement of the cover to a lifted position.

The above and still further objects and advantages will become apparent from the following description.

BRIEF DESCRIPTION OF THE DRAWINGS

Preferred embodiments of the invention are described below with reference to the following accompanying drawings.

FIG. 7 is an exploded perspective view illustrating a preferred assembly of the preferred mounting bracket and carrier, the carrier being shown fragmented.

DETAILED DESCRIPTION OF THE PREFERRED EMBODIMENTS

Figure 1:
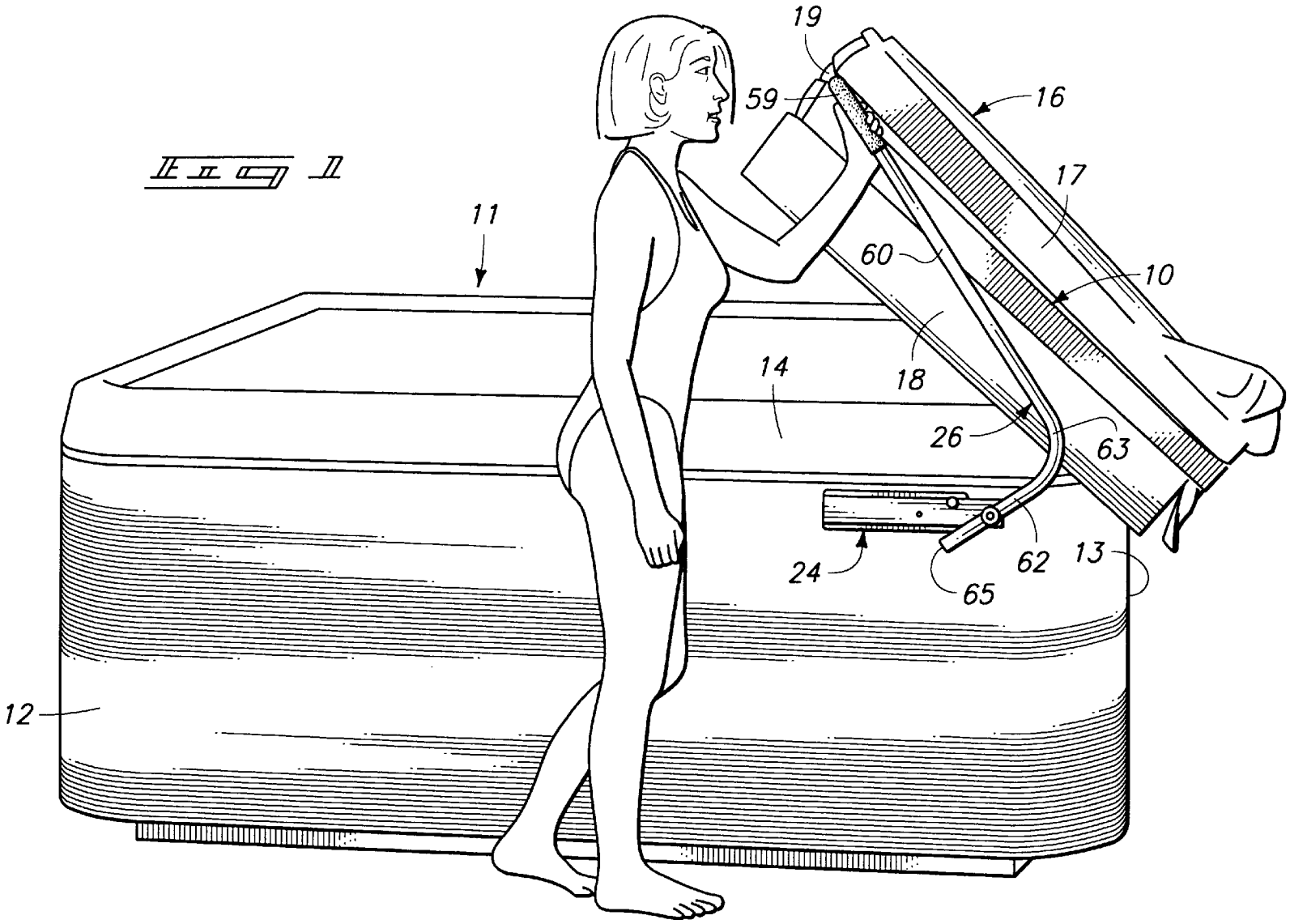
FIG. 1 is a perspective view of a preferred form of the present cover lift frame in use on a spa to lift a spa cover.

This disclosure of the invention is submitted in furtherance of the constitutional purposes of the U.S. Patent Laws "to promote the progress of science and useful arts" (Article 1, Section 8).

A preferred example of a spa lift frame incorporating features of the present invention is generally designated in the drawings by reference numeral 10, In order to gain an understanding of the structural elements of the frame 10, a brief description of a spa 11 is in order. It is to be understood however that the spa and cover are not part of the claimed invention. However, a description of the related spa components is presented herein to lend life and meaning to the claimed invention.

The spa 11 may be of numerous commercial configurations which include at least two opposed walls that may be considered side walls 12, and an end wall 13 between the side walls. The top and end walls terminate upwardly at a spa top 14, which typically defines the top opening of tie spa. The top 14 may be flush with the side and end walls or extend slightly outwardly of the spa walls as shown by dashed lines in FIG. 4.

Figure 2:
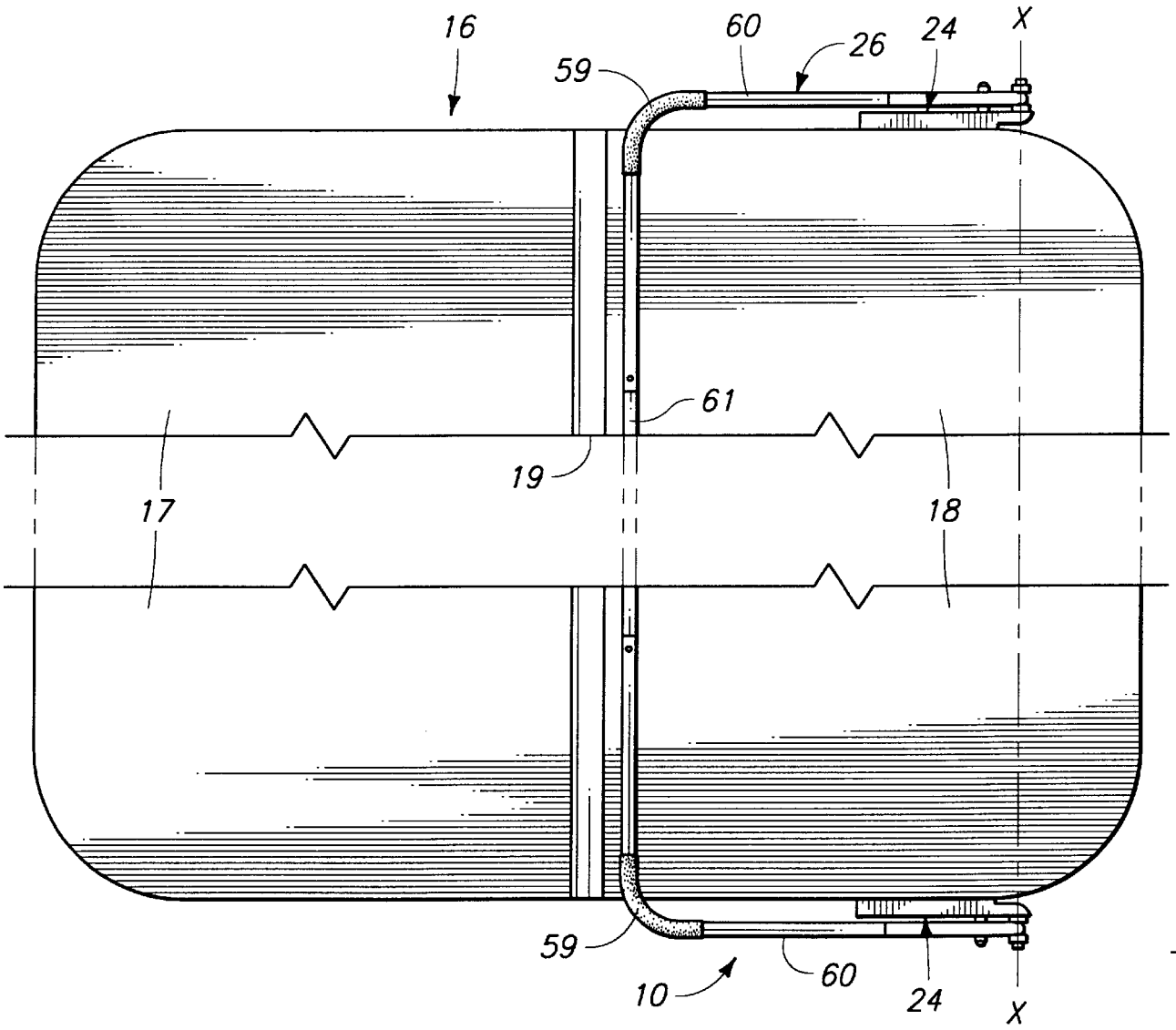
FIG. 2 is a top plan view of a spa cover with the preferred lift frame positioned in relation thereto.

Spa covers such as the rectangular cover shown at 16 in FIGS. 1 and 2 are designed to complement the spa shape and to rest on the spa top 14 to insulate and protect the water below. The cover 16 typically is provided in two halves 17, 18 that are joined by a hinge 19 typically formed by a seam in a flexible covering of the cover halves.

The spa shown in the drawings is substantially rectangular with rounded corners. This is a popular spa configuration but other configurations are also in use. Hexagonal or octagonal spa configurations are known as well as nonsymmetrical polygonal configurations (for example partially truncated rectangular configurations), and other shapes some of which include two or more sides that are curved.

It is likely that the end wall 13 will be in opposition to another end wall, but for purposes of the present description the "end wall" 13 of concern is considered to be that wall of the spa 11 against which the cover 16 is to be stored. Either end may be selected for mounting and operation of the present lift frame 10. It is fairly typical that the selected end wall 13 will be situated adjacent to a structural wall, a deck rail or other structural surface. The present lift frame 10 will permit positioning of the cover 16 in such a location with a minimum required clearance between the end wall and adjacent structural surface (usually between 9 and 15 inches).

Turning now to details of the presently preferred lift frame 10, reference is first made generally to FIGS. 1 and 2. There it may be seen that the preferred lift frame 10 generally includes left and right mounting brackets 24. The brackets 24 are configured to be mounted to respective left and right spa side walls 12 adjacent the selected spa end wall 13.

A "U" shaped carrier 26 is provided, and is mounted to the brackets 24 for pivotal movement about a lift axis X (FIGS.

2, 6 and 7) to carry the cover 16 (in a folded condition) between a position on the spa top (FIG. 2), and the raised position (FIG. 3) adjacent to the selected spa end wall 13.

Referring now to more specific preferred features of the lift frame 10, attention is drawn firstly to FIGS. 3–7 where details of the mounting brackets 24 are shown. The mounting brackets 24 are preferably formed by conventional means of appropriate metal such as steel. It is preferred that the brackets be mirror images of one another, and that the:y otherwise be substantially identical. Description of one mounting bracket will therefore suffice for description of the other.

Each mounting bracket includes at least one and preferably a pair of elongated bracket flanges 30 that extend along the mounting bracket between a first end 31 and a second end 32. The bracket flanges 30 are configured to fit flush against a side wall 12 of the spa with the second end 32 adjacent the end wall 13.

Mounting holes 33 (FIGS. 3 and 7) are preferably formed through and along the bracket flanges 30 at least adjacent the first ends 31 thereof. The holes 33 receive fasteners 34 such as the screws exemplified in FIG. 4 for securing the mounting brackets to the spa side walls 12.

Each of the mounting brackets 24 includes a pivot mounting flange 36 that is preferably integral with the associated bracket flanges 30. The pivot mounting flange 36 is comprised of a flat portion of the mounting bracket that is spaced outwardly of the bracket flanges 30 by preferred integral offset flanges 35. This is done to enable mounting of the carrier 26 without interference with the spa side walls, and to space the mounted parts of the carriers from the side walls by distances sufficient to enable mounting of the lift frame to spas having either flush tops 14 (solid lines, FIG. 4) or tops that extend outwardly of the side walls (dashed lines, FIG. 4).

In preferred forms, each mounting bracket 24 includes a pivot mount 37 provided on the pivot mounting flange 36 adjacent the second end 32 of the elongated bracket flanges 30. In the examples shown, the pivot mounts 37 are situated forwardly of the bracket flange second ends 32. This arrangement is preferred to allow positioning of the lift axis close to the plane of the spa end wall, regardless of bends (FIG. 2) that may occur between the spa side walls and end wall.

In further preferred forms, the mounting brackets include web sections 41 on the mounting brackets adjacent to the pivot mounts and spaced toward the bracket flanges 30. The web sections 41 may be welded or otherwise secured to the mounting brackets, outwardly of the bracket flanges 30.

The pivot mounts 37 may be simply comprised of mounting holes formed through the pivot mounting flanges 36 and the web sections 41. The holes are aligned to receive pivots, in the preferred form of conventional bolts 40. The bolts are stabilized by the web sections 41 and pivot mounting flanges, and define the lift axis X for the carrier 26.

In preferred forms of the present lift frame 10, pivot stops 43 are provided on pivot stop mounts 38 between the carrier 26 and mounting brackets 24. The preferred pivot stops 43 are positioned to engage and prevent pivotal movement of the carrier beyond the raised position in which the carrier is substantially upright.

As shown in FIGS. 4–7, the preferred pivot stops 43 are welded to the mounting brackets 24 and are provided with a resilient covering material such as rubber. They are most preferably situated toward the first ends 31 of the bracket flanges 30 from the pivot mounts 37 and in the swing path of carrier parts that will be described below.

The carrier 26 in preferred forms includes opposed substantially parallel support arm members 60 and a cross member 61 extending between the support arm members 60. The carrier 26 further includes end extensions 62 on the support arm members leading angularly from the support arm members 60. The cross member 61 is provided to span the width dimension of the spa cover as shown in FIG. 2, and the support arm members are provided with sufficient length from the lift axis to position the cross member just short of the hinge 19 (as also shown in FIG. 2) when the carrier is swung downwardly to rest on the spa cover 16.

The support arm members 60, the cross member 61 and end extensions 62 may be formed of tubular metal such as aluminum. Further, the components of the carrier may be provided in several interfitting parts, or be integral (formed of a single tubular member). Soft rubber hand grips 59 may be provided, at the junctures of the cross member 61 and the support arm members 60 to ease lifting.

Bend sections 63 join the end extensions 62 and support arm members 60. The bend sections 63 preferably orient the end extensions 62 at approximate right angles to the support arm members 60. The bend sections 63 also offset the support arm members 60 with respect to the lift axis X, as shown in FIG. 1.

Figure 3:
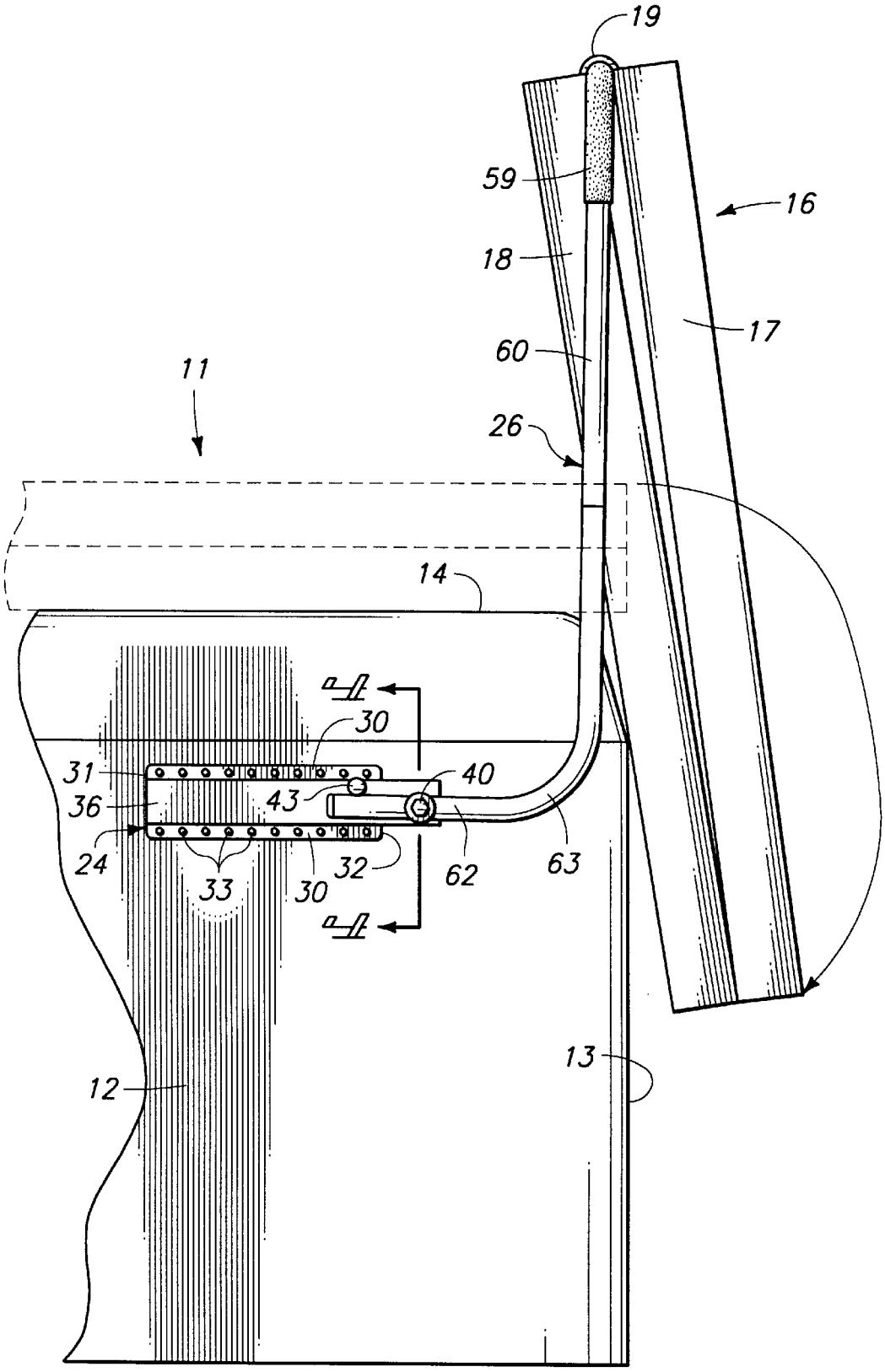
FIG. 3 is an enlarged side view of the preferred lift frame carrying a folded spa cover in a raised position adjacent a spa end.

The lift axis, defined by the pivot bolts 40 intersects the end extensions 62 between the bend sections 63 and end extension free ends 65. Thus the bend sections 63 are on one side of the lift axis X, and the ends 65 are situated on an opposite side as may be seen in FIG. 5. The free ends 65 are spaced from the lift axis X to engage the pivot stops when the carrier is in the raised position (FIG. 3).

In preferred forms, the bend sections 63 are reinforced by internal tubular reinforcing members 64. The reinforcing members 64 may be tubular like the bend sections 63, and are preferably slid into position prior to forming the bend sections 63. The bend sections 63 thereafter hold the reinforcing members 64 in position within the tubular carrier 26. Thus positioned, the reinforcing members 64 brace the carrier 26 against racking when it is used to lift a spa cover 16.

Figure 4:
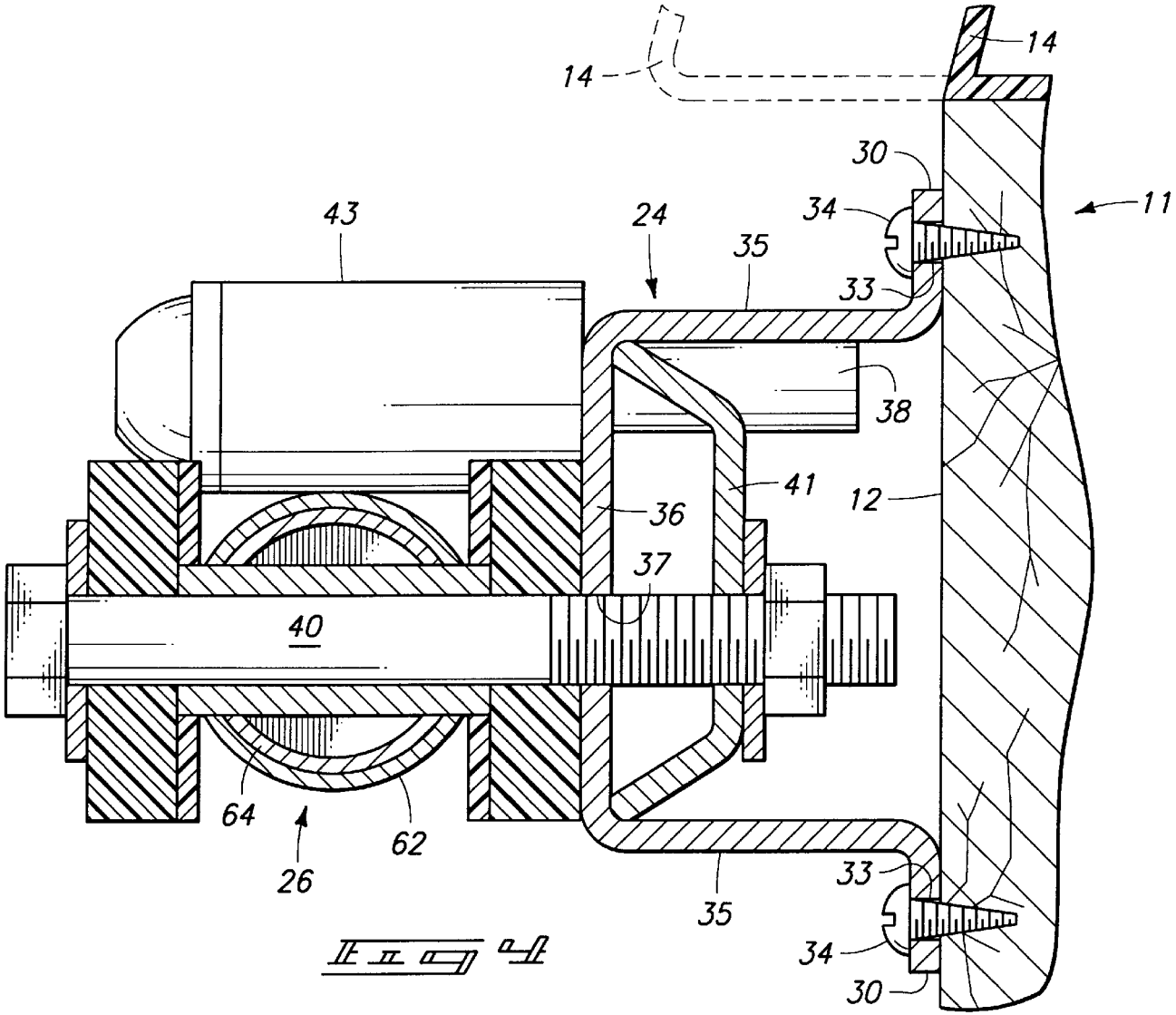
FIG. 4 is an enlarged sectional view taken substantially along line 4—4 in FIG. 3.
Figure 5:
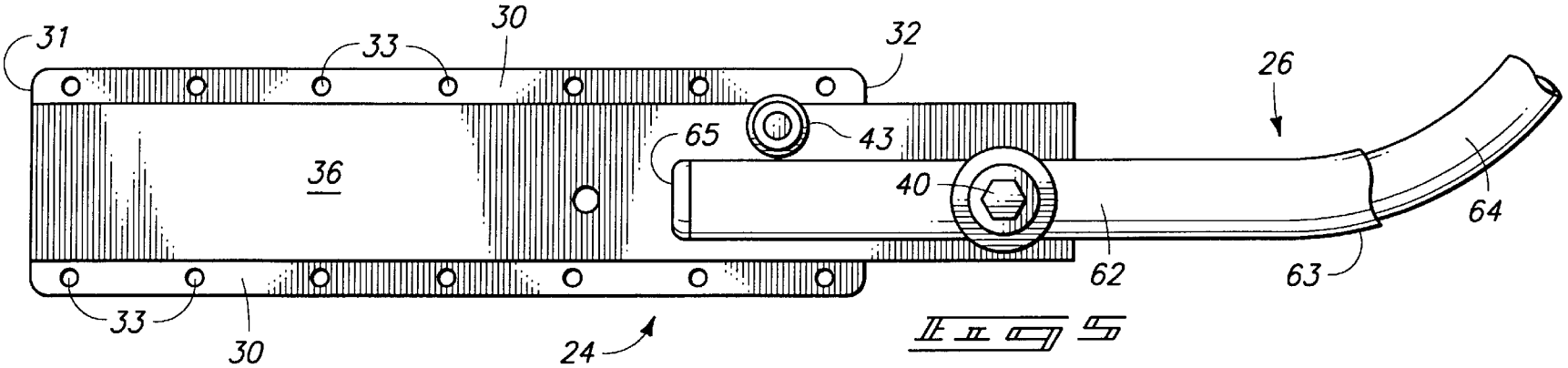
FIG. 5 is an enlarged side elevation view of a preferred mounting bracket and with a fragmented part of a carrier mounted to the bracket.
Figure 6:
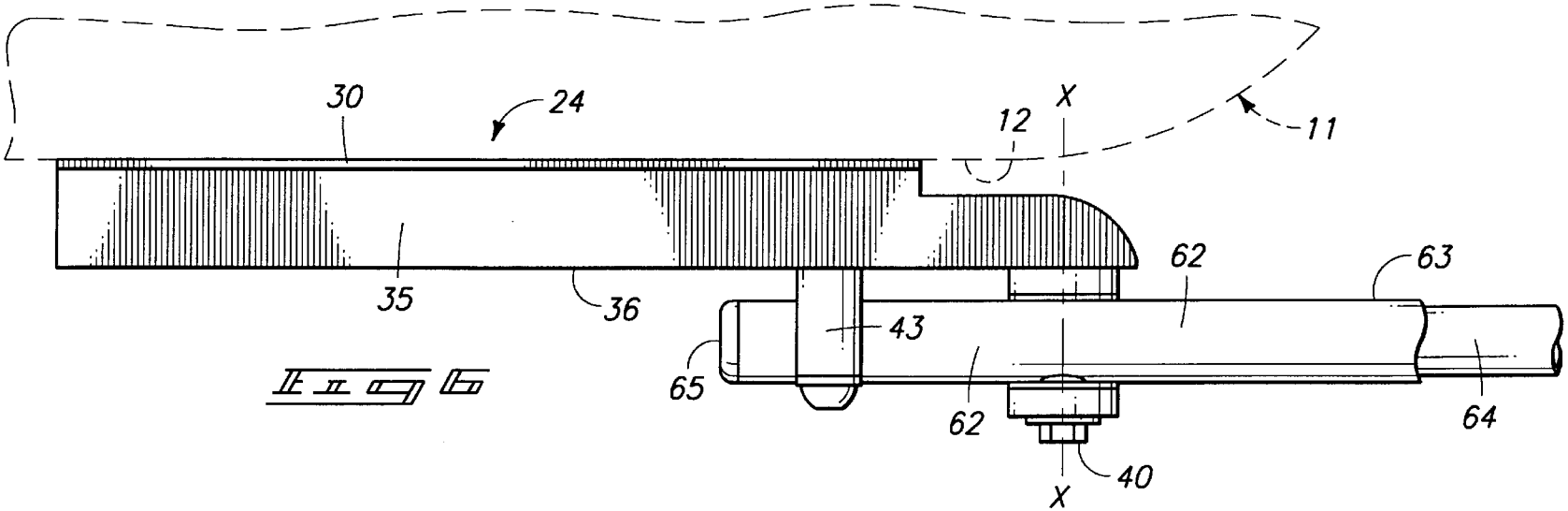
FIG. 6 is a plan view substantially as viewed from above in FIG. 5.

The reinforcing members 64 preferably extend into the support arms 60, through the bend sections 63, and into the end extensions 62 past the pivot bolts 40. The end extensions 62 and reinforcing members 64 are appropriately drilled to receive the bolts 40, as shown in FIG. 4. The reinforcing members 64 thereby serve to reinforce the carrier at the pivot points and add rigidity to the support arms.

The preferred cover lift 10 is mounted to a spa in several relatively easy steps. Firstly the installer will position the spa cover 16 on the spa top 14, making sure that all corners are properly aligned above complementary corners of the spa. Using the fasteners 34, the left and right mounting brackets 24 are attached to the left and right side walls 12, 13 of the spa. By positioning the brackets approximately eight inches down from the spa top 14, approximately nine inches of clearance behind the spa (adjacent the end wall 13) will be needed. Mounted in this position approximately 75% of the spa cover 16 will be standing above the spa top 14 in the raised position. This is the position illustrated in FIG. 3.

If the mounting brackets 24 are positioned lower, say twelve inches down from the spa top 14, approximately fifteen inches of clearance behind the spa will be needed. However with the brackets in this position, approximately 50% of the spa cover will be standing above the spa top 14 when the spa is in the raised position.

Regardless of the elevational position selected for the mounting brackets, it is preferred that the pivot mounts 37

(mounting holes) be positioned approximately nine inches from the spa end wall 13. This locates the lift axis at a preferred location to enable lifting of the spa cover 16 with maximum ease, and so the folded cover 16 and carrier 26 will be oriented substantially upright when in the raised position.

Figure 8B:
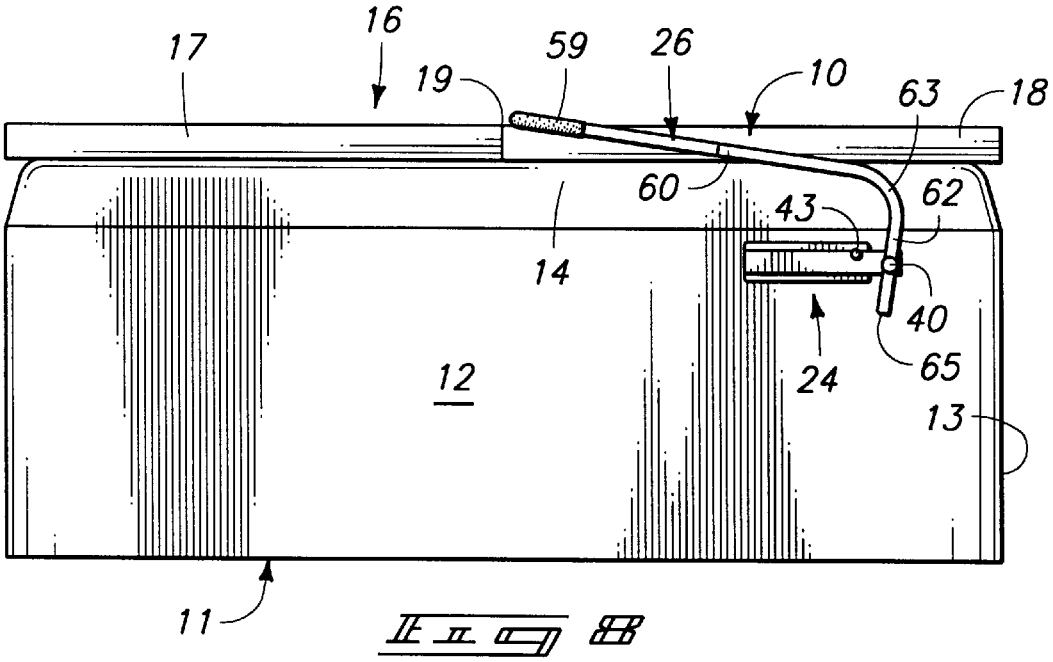

Once the mounting brackets are secured to the spa side walls, the carrier may be attached. This is done simply by first inserting the pivot bolts substantially as shown in FIG. 7 through the end extensions 62, along with various spacers and washers supplied. If the carrier is provided in several sections, the sections are next secured together such that the support arms will extend along the sides of the cover, and the cross member 61 will span the cover just short of the hinge 19 (see FIGS. 2 and 8).

Now the carrier 26 is ready for use.

Figure 9:
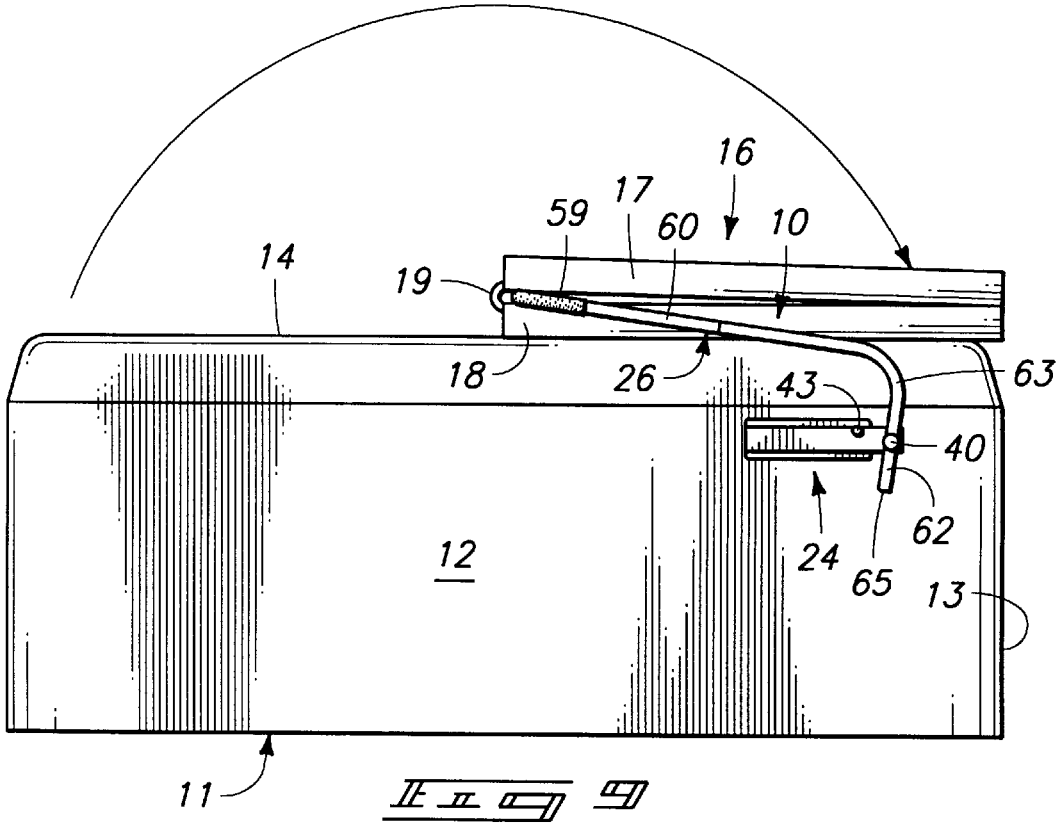

To lift a cover 16, the cover half furthest away from the lift axis is first folded over the cross member 61. This step is shown in FIG. 9 and the folding motion is identified by a dashed line.

Figure 11:
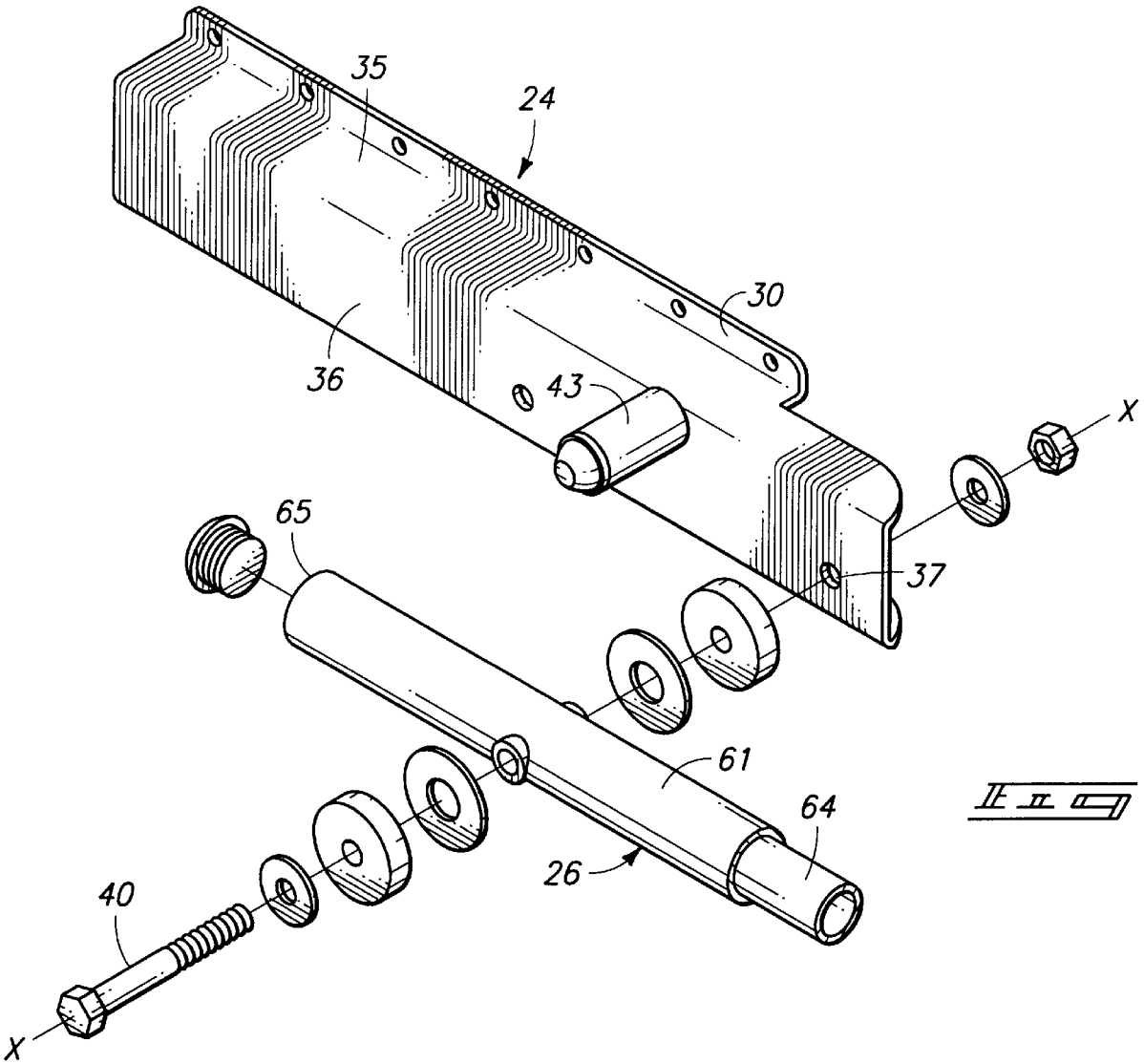
FIGS. 8–11 are a sequence of operational views illustrating the steps for lifting a spa cover from a spa covering position to a raised position.
Figure 10:
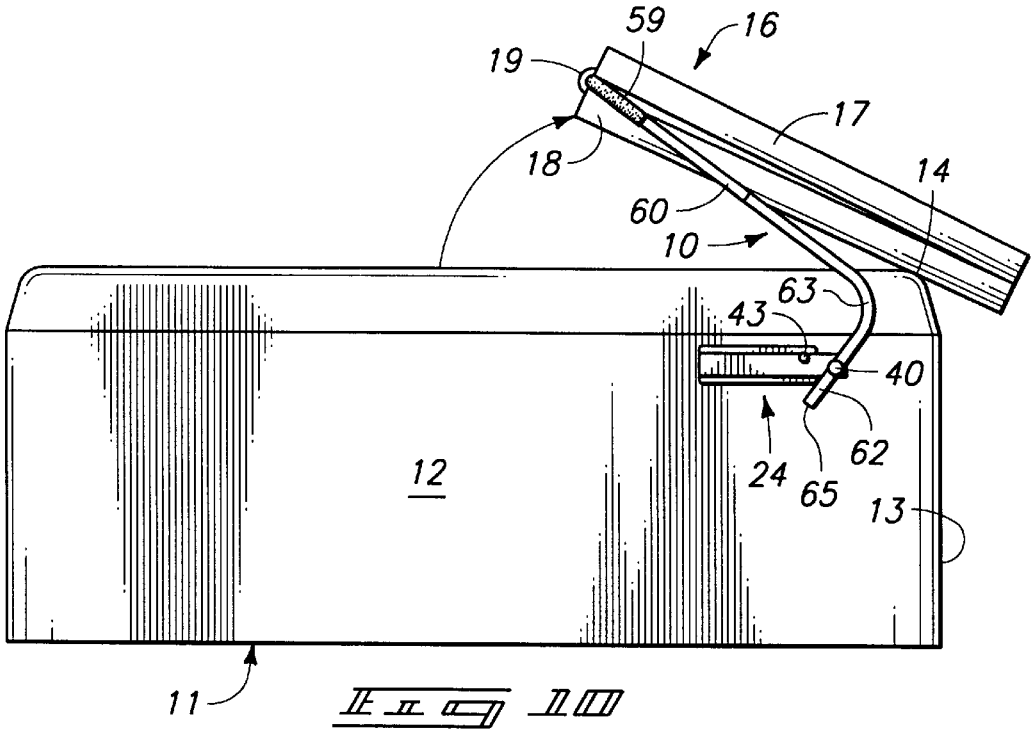
Figure 11:
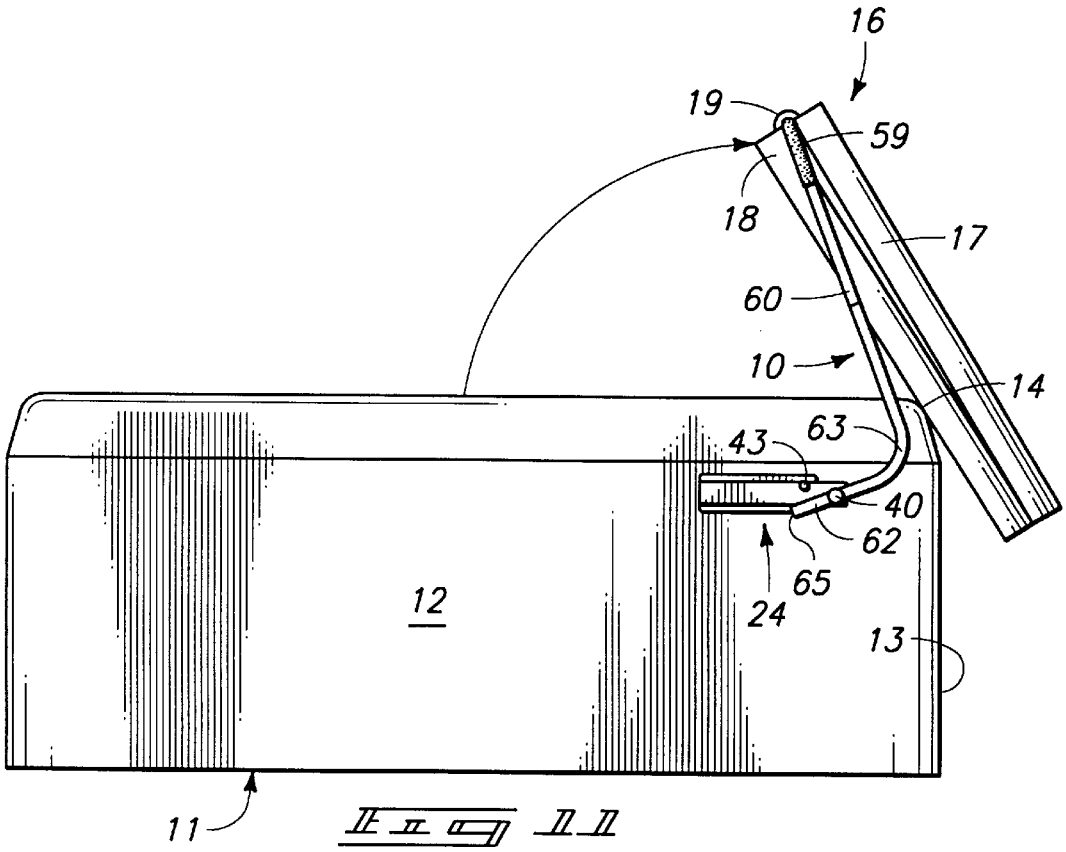

Now the user may simply grasp one of the hand grips 59 along side the spa as shown in FIG. 1 and lift upwardly. The spa cover will be lifted upwardly by the cross member 61 and will both pivot about and slide over the top of the spa at the end wall 13. A portion of the cover weight will thus be borne by the spa top as the cover slides over the spa top at a point adjacent the end wall 13 (FIGS. 10 and 11).

Finally, when the cover reaches the raised position, the end extensions 62 will come into abutment with the pivot stops 43 and the cover will not pivot further (FIG. 3). The weight of the cover, acting against the carrier at the lift axis X, will hold the cover and carrier in the raised position until the user desires to lower the cover, at which time the above process is repeated in reverse.

It is noted that the geometry of the carrier in relation to the lift axis X is such that the weight of the cover is not completely borne by the user, and that the lifting and subsequent lowering steps may be performed with little effort. This may be attributed to the orientation of the mounting brackets 24, and to the bend sections 63 which function to space the support arms 60 and cross member 61 toward the end wall 13 of the spa, between the lift axis X and the spa end wall when the carrier is in the raised position.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A spa cover lift frame for a spa cover which is formed of two halves joined along a central hinge and rests against the top of a spa having upright left and right spa side walls and an end wall leading downwardly from the spa top, said lift frame comprising:

left and right mounting brackets configured to be mounted to respective left and right spa side walls adjacent the end wall;

a "U" shaped carrier including opposed substantially parallel support arm members and a cross member extending between the support arm members;

the carrier further including end extensions on the support arm members leading angularly from the support arm members;

pivots joining the end extensions and the mounting brackets and enabling pivotal movement of the carrier about a lift axis;

pivot stops positioned between the end extensions and mounting brackets to engage and prevent pivotal movement of the carrier beyond a position in which the support arm members are substantially upright; and wherein the left and right mounting brackets and the carrier are configured to be mounted on the spa with the carrier pivotable on the lift axis between a down position wherein the cross member is positioned against the spa cover adjacent the hinge such that the spa cover may be folded over the cross member, and a raised position wherein the folded spa cover is supported on the cross member and is substantially upright and adjacent to the spa end wall.

2. A spa cover lift frame as defined by claim 1 wherein the end extensions are oriented at substantially right angles to the support arm members.

3. A spa cover lift frame as defined by claim 1 wherein the lift axis intersects the end extensions.

4. A spa cover lift frame as defined by claim 1 wherein the end extensions are oriented at approximate right angles to the support arm members and wherein the lift axis intersects the end sections.

5. A spa cover lift frame as defined by claim 1 wherein the end extensions are integral with the support arm members and are joined with the support arm members at bend sections.

6. A spa cover lift frame as defined by claim 1 wherein the end extensions are integral with the support arm members and are joined with the support arm members at bend sections forming approximate right angles between the end extensions and the support arm members.

7. A spa cover lift frame as defined by claim 1 wherein the end extensions are integral with the support arm members and are joined with the support arm members at bend sections forming approximate right angles between the end extensions and the support arm members and wherein the lift axis intersects the end extensions on one side of the bend sections.

8. A spa cover lift frame as defined by claim 1 wherein the end extensions and support arm members are tubular, with internal bores and further comprising internal reinforcing members within the bores and extending into the support arm members and end extensions.

9. A spa cover lift frame as defined by claim 1 wherein each of the left and right mounting brackets are comprised of:

a bracket flange configured to be secured to a side wall of the spa adjacent the end wall;

a pivot mounting flange; and an offset flange joining the bracket flange and pivot mounting flange and spacing the pivot mounting flange from the bracket flange.

10. A spa cover lift frame as defined by claim 1 wherein each of the left and right mounting brackets are comprised of:

a bracket flange configured to be secured to a side wall of the spa adjacent the end wall;

a pivot mounting flange;

a pivot mount on the pivot mounting flange, mounting one of the pivots;

an offset flange joining the bracket flange and pivot mounting flange and spacing the pivot mounting flange from the bracket flange; and a pivot stop mount on the pivot mounting flange.

11. A spa cover lift frame as defined by claim 1 wherein each of the left and right mounting brackets are comprised of:

an elongated bracket flange including a first end and a second end the bracket flange being configured to fit flush against a side wall of the spa with the second end adjacent the end wall;

mounting holes formed through and along the bracket flange at least adjacent the first end thereof;

a pivot mounting flange;

a pivot mount on the pivot mounting flange adjacent the second end of the elongated bracket flange mounting one of the pivots;

an offset flange joining the bracket flange and pivot mounting flange and spacing the pivot mounting flange from the bracket flange.

12. A spa cover lift frame as defined by claim 1 wherein each of the left and right mounting brackets are comprised of:

an elongated bracket flange including a first end and a second end, the bracket flange being configured to fit flush against a side wall of the spa with the second end adjacent the end wall;

mounting holes formed through and along the bracket flange at least adjacent the first end thereof;

a pivot mounting flange;

a pivot mount on the pivot mounting flange adjacent the second end of the elongated bracket flange mounting one of the pivots;

an offset flange joining the bracket flange and pivot mounting flange and spacing the pivot mounting flange from the bracket flange; and a pivot stop mount on the pivot mounting flange spaced toward the first end from the pivot mount.

13. A spa cover lift frame for a spa cover which is formed of two halves joined along a central hinge and rests against the top of a spa having upright left and right spa side walls and an end wall leading downwardly from the spa top, said lift frame comprising:

left and right mounting brackets configured to be mounted to respective left and right spa side walls adjacent the end wall;

each of the left and right mounting brackets being comprised of an elongated bracket flange including a first end and a second end; the bracket flange being configured to fit flush against a side wall of the spa with the second end adjacent the end wall; mounting holes formed through and along the bracket flange at least adjacent the first end thereof; a pivot mounting flange 36; a pivot mount on the pivot mounting flange adjacent the second end of the elongated bracket flange; an offset flange 35 joining the bracket flange and pivot mounting flange and spacing the pivot mounting flange from the bracket flange;

a "U" shaped carrier including opposed substantially parallel support arm members and a cross member extending between the support arm members;

the carrier further including end extensions of the support arm members leading angularly from the support arm members pivots joining the end extensions and the pivot mounts, enabling pivotal movement of the carrier about a lift axis; and wherein the left and right mounting brackets and the carrier are configured to be mounted on the spa side walls with the carrier pivotable on the lift axis between a down position wherein the cross member is positioned against the spa cover adjacent the hinge such that the spa cover may be folded over the cross member, and a raised position wherein the folded spa cover is supported on the cross member and is substantially upright and adjacent to the spa end wall.

14. A spa cover lift frame as defined by claim 13, further comprising:

pivot stops positioned between the carrier and mounting brackets to engage and prevent pivotal movement of the carrier beyond a position in which the support arm members are substantially upright.

15. A spa cover lift frame as defined by claim 13 further comprising:

pivot stops mounted on the mounting brackets and positioned toward the first ends from the pivot mounts to engage and prevent pivotal movement of the carrier beyond a position in which the support arm members are substantially upright.

16. A spa cover lift frame as defined by claim 13 wherein the pivots are comprised of bolts centered on the lift axis and pivotably joining the carrier and pivot mounts;

wherein the mounting brackets further include web sections on the mounting brackets adjacent to the pivot mounts and spaced toward the bracket flanges;

wherein the web sections receive the bolts; and wherein the bolts span the web sections and pivot mounts and extend to engage the carrier.

17. A spa cover lift frame for a spa cover which is formed of two halves joined along a central hinge and rests against the top of a spa having upright left and right spa side walls and an end wall leading downwardly from the spa top, said lift frame comprising:

left and right mounting brackets configured to be mounted to respective left and right spa side walls adjacent the end wall;

a "U" shaped carrier including opposed substantially parallel support arm members and a cross member extending between the support arm members;

the carrier further including end extensions on the support arm members leading angularly from the support arm members;

pivots joining the end extensions and the mounting brackets and enabling pivotal movement of the carrier about a lift axis;

wherein the left and right mounting brackets and the carrier are configured to be mounted on the spa with the carrier pivotable on the lift axis between a down position wherein the cross member is positioned against the spa cover adjacent the hinge such that the spa cover may be folded over the cross member, and a raised position wherein the folded spa cover is supported on the cross member and is substantially upright and adjacent to the spa end wall.

18. A spa cover lift frame as defined by claim 17 wherein the end extensions are oriented at substantially right angles to the support arm members.

19. A spa cover lift frame as defined by claim 17 wherein the lift axis intersects the end extensions.

20. A spa cover lift frame as defined by claim 17 wherein the end extensions are oriented at approximate right angles to the support arm members and wherein the lift axis intersects the end sections.

21. A spa cover lift frame as defined by claim 17 wherein the end extensions are integral with the support arm members and are joined with the support arm members at bend sections.

22. A spa cover lift frame as defined by claim 17 wherein the end extensions are integral with the support arm members and are joined with the support arm members at bend sections forming approximate right angles between the end extensions and the support arm members.

23. A spa cover lift frame as defined by claim 17 wherein the end extensions are integral with the support arm members and are joined with the support arm members at bend sections forming approximate right angles between the end extensions and the support arm members and wherein the lift axis intersects the end extensions.

24. A spa cover lift frame as defined by claim 17 wherein the end extensions and support arm members are tubular, with internal bores and further comprising internal reinforcing members within the bores and extending into the support arm members and end extensions.

* * * * *